United States Patent [19]

Klipp

[11] Patent Number: 4,913,391

[45] Date of Patent: Apr. 3, 1990

[54] SPORTSMAN'S GUN REST AND OBJECT HOLDER

[76] Inventor: Kenneth W. Klipp, 7013 Willowtree Dr., Middletown, Md. 21769

[21] Appl. No.: 237,375

[22] Filed: Aug. 29, 1988

[51] Int. Cl.[4] ..... F41C 29/00

[52] U.S. Cl. ..... 248/214; 248/231.7; 248/296; 42/94

[58] Field of Search ..... 248/511, 514, 521, 534, 248/538, 70, 124, 125, 214, 231.7, 295.1, 296, 309.1; 42/94, 100; 211/64; 224/913

[56] References Cited

U.S. PATENT DOCUMENTS

| | | | |
|---|---|---|---|
| 167,169 | 8/1875 | Hare | 42/94 |
| 462,319 | 11/1891 | Loehner | 248/231.7 |
| 503,338 | 8/1893 | Woods | 248/514 |
| 937,480 | 10/1909 | Smith | 248/231.7 |
| 1,890,423 | 12/1932 | Teagarden | 42/94 |
| 2,898,069 | 8/1959 | Kramer | 248/231.7 |
| 2,913,740 | 11/1959 | Eldridge | 248/68.1 |
| 3,022,898 | 2/1962 | Loeb | 211/64 |
| 3,178,144 | 4/1965 | Kimoto | 248/309.1 |
| 3,225,656 | 12/1965 | Flaherty | 42/94 |
| 4,026,057 | 5/1977 | Cady | 42/94 |
| 4,438,581 | 3/1984 | LaValle | 42/94 |
| 4,575,964 | 3/1986 | Griffin | 42/94 |

FOREIGN PATENT DOCUMENTS

| | | | |
|---|---|---|---|
| 518237 | 1/1931 | Fed. Rep. of Germany | 248/514 |
| 1185511 | 1/1965 | Fed. Rep. of Germany | 42/94 |
| 1284657 | 12/1968 | Fed. Rep. of Germany | 248/214 |
| 861284 | 10/1940 | France | 42/94 |
| 403559 | 6/1966 | Switzerland | 248/231.7 |

*Primary Examiner*—Ramon O. Ramirez
*Assistant Examiner*—Robert A. Olson
*Attorney, Agent, or Firm*—Eugene F. Osborne, Sr.

[57] ABSTRACT

A gun rest and sports equipment holder for use on railings of a tree stand, fence, porch deck, or the like includes a portable bracket with attaching clamp, a cradle for a gun rest rest and an optional adaptor for holding spotting telescopes and cameras is adjustable for various viewing heights and azimuth angles by the attending hunter or sportsman and serves to stabilize the aiming of long barrel firearms, spotting scopes, or cameras.

2 Claims, 3 Drawing Sheets

SPORTSMAN'S GUN REST AND OBJECT HOLDER

BACKGROUND OF THE INVENTION

1. Field of the Invention

This invention relates to the field of accessory equipment for sportsmen and more particularly to a rest device for supporting a gun, a spotting scope, a camera, or similar objects, on an upstanding structural member of a stand, hunter's blind, or the like.

2. Related Prior Art

A number of patents have been issued covering gun rests to be used for ground or bench applications where the hunter or sportsman lies prone upon the ground, is kneeling upon the ground, or is sitting at a bench. There are tripods, bipedestals, monopedestals, telescoping pedestal devices, and benches. One patent, U.S. Pat. No. 3,022,898, issued to Loeb in 1962 provides gun support from an upright member, such as a tree, stump, or post. The device of Loeb provides two point gun support in a fixed limited direction when strapped to a tree, post or stump. The objective of Loeb is to provide a holder for a gun during the time prior to its actual use so as to release the hunter's hands to perform other functions during waiting periods.

SUMMARY OF THE INVENTION

This invention is a portable device for use by a sportsman as a rest for attachment to a structural member having an upright dimension such as a railing about a tree stand, fence or porch deck. The rest is adjustable in elevation and in a wide range of azimuth angles during its attachment to the structural member, thus it has the flexibility desired for the sporting event, for sportsmen of various heights. The invention has a primary function in improving the directional (aiming) stability of the gun, scope, or camera during its actual use for the purpose intended and secondary functions in holding such sporting equipment in waiting interval of its non-use.

One object of this invention is to provide a sporting equipment rest device for use on a railing of a tree stand, deck, fence or the like.

Another object of this invention is to provide a rest device having elevation and azimuth adjustment capabilities.

Another object of this invention is to provide a rest device having optional support capabilities for firearms, spotting telescopes, and sportsman's cameras.

Another object of this invention is to improve the aiming directional stability of sporting equipment during use for the purpose designed.

Still another object of this invention is to hold sporting equipment during waiting intervals so as to release the attending sportsman's hands to perform other functions.

BRIEF DESCRIPTION OF THE DRAWINGS

Other objects and advantages of the invention will become apparent from a reading of the description in connection with the accompanying drawings of preferred embodiments, in which.

DETAILED DESCRIPTION

Figure 1:
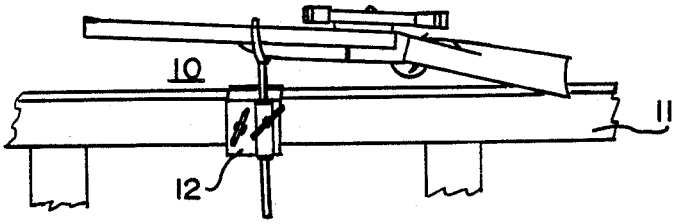
FIG. 1 is an illustration of a hunter's tree stand application of the stabilizing gun rest.

The application of a hunter's tree stand stabilizing gun rest 10 is illustrated in FIG. 1. A stationary rail 11 of a tree stand or hunter's blind has dimensions in thickness in the range of ¼ to 3 inches and in height, at least 2 inches. The gun rest 10 is placed upon the rail 11 in a manner to locate a plate of the inverted U-shaped bracket 12 on each front and rear side of the rail 11. A threaded bracket screw clamp 13, FIG. 2, extending through the forward plate 14 and a nut 15 attached thereto, is advanced to compress the rail 11 against the rear plate 16 thereby providing a fixed gun rest having the rigidity and stability of the tree stand structure.

Figure 3:
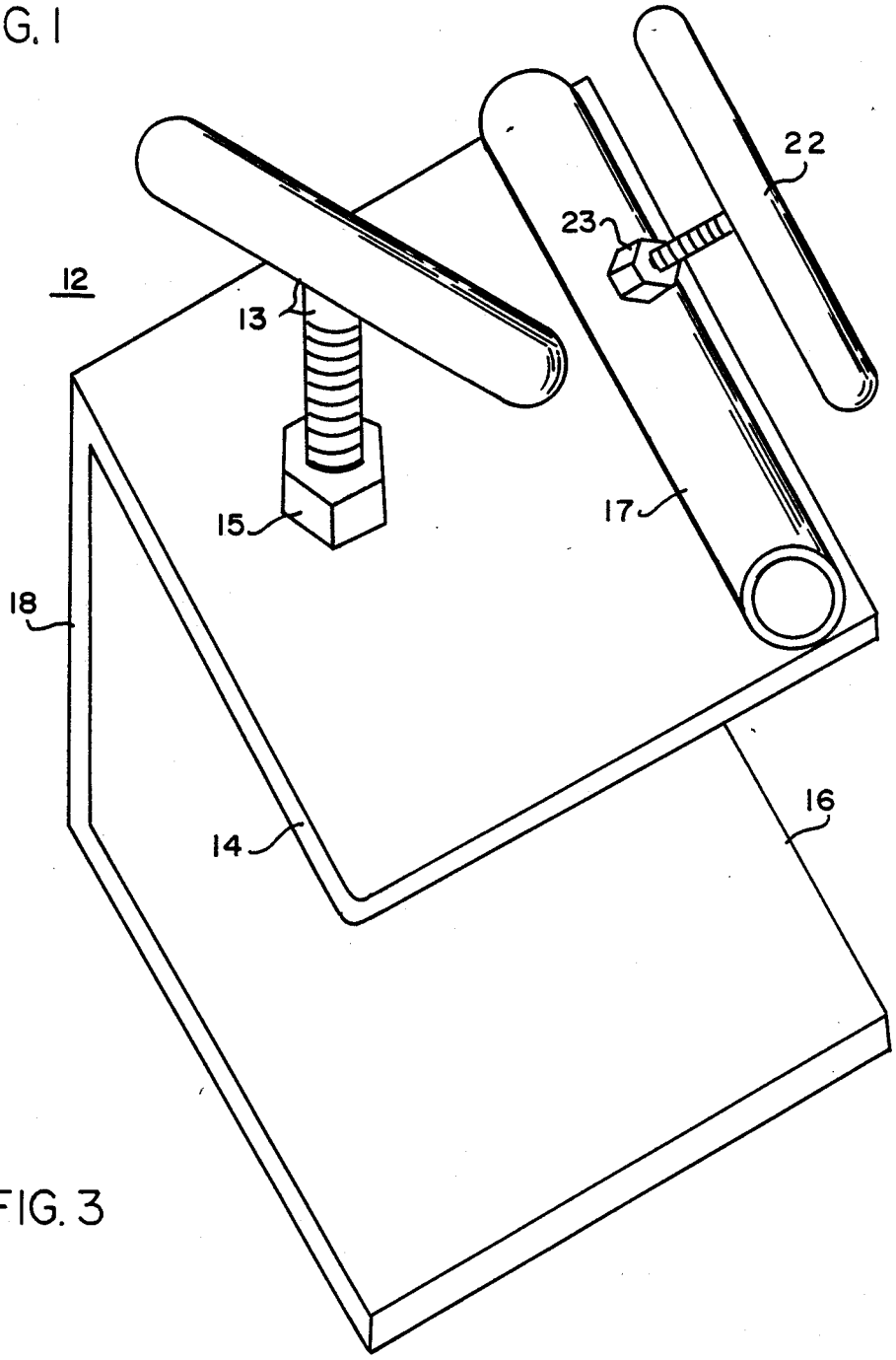
FIG. 3 is a perspective of the mounting bracket and clamps.
Figure 2:
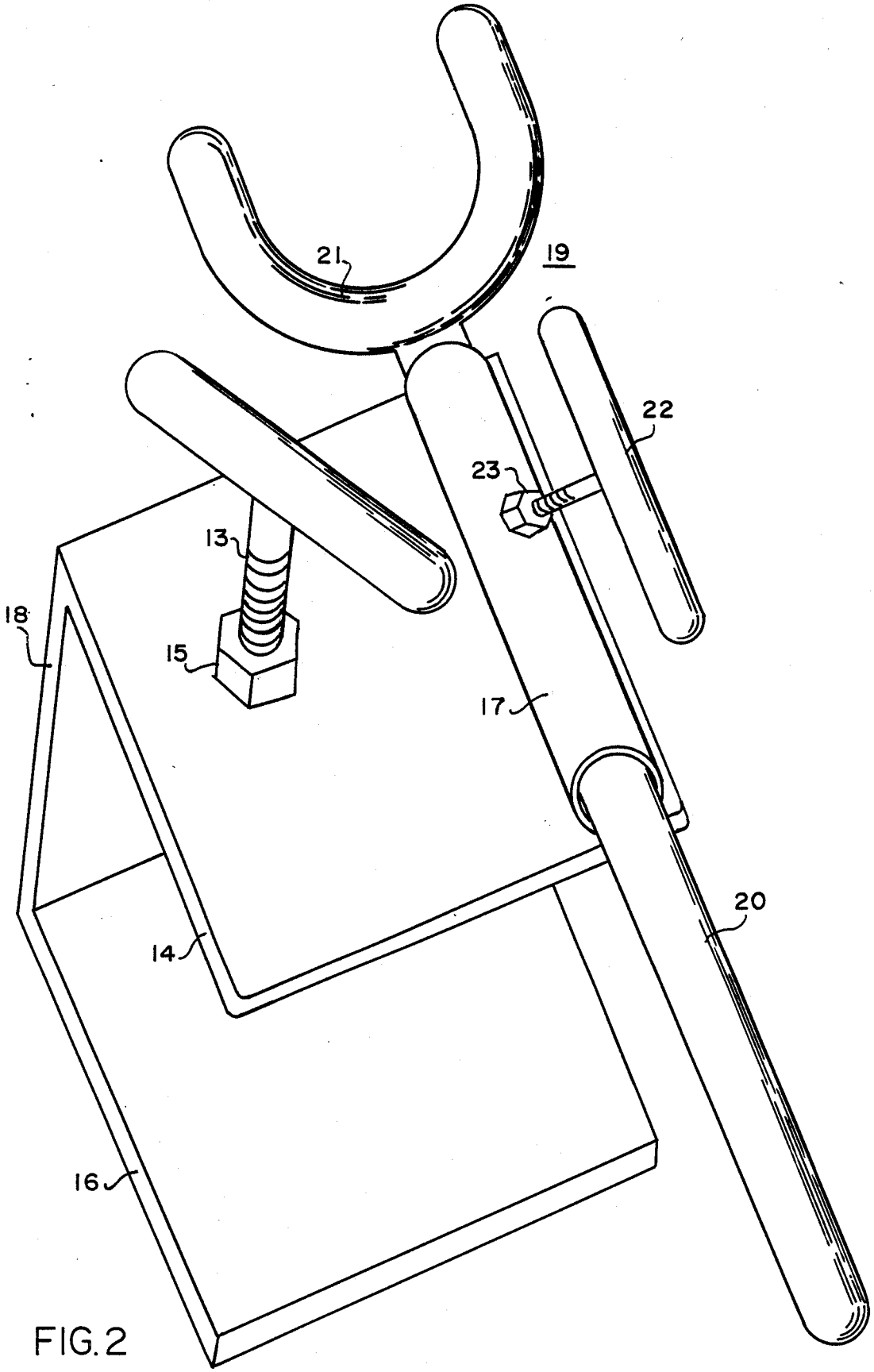
FIG. 2 is a perspective of a single yoke stabilizing gun rest.
Figure 4:
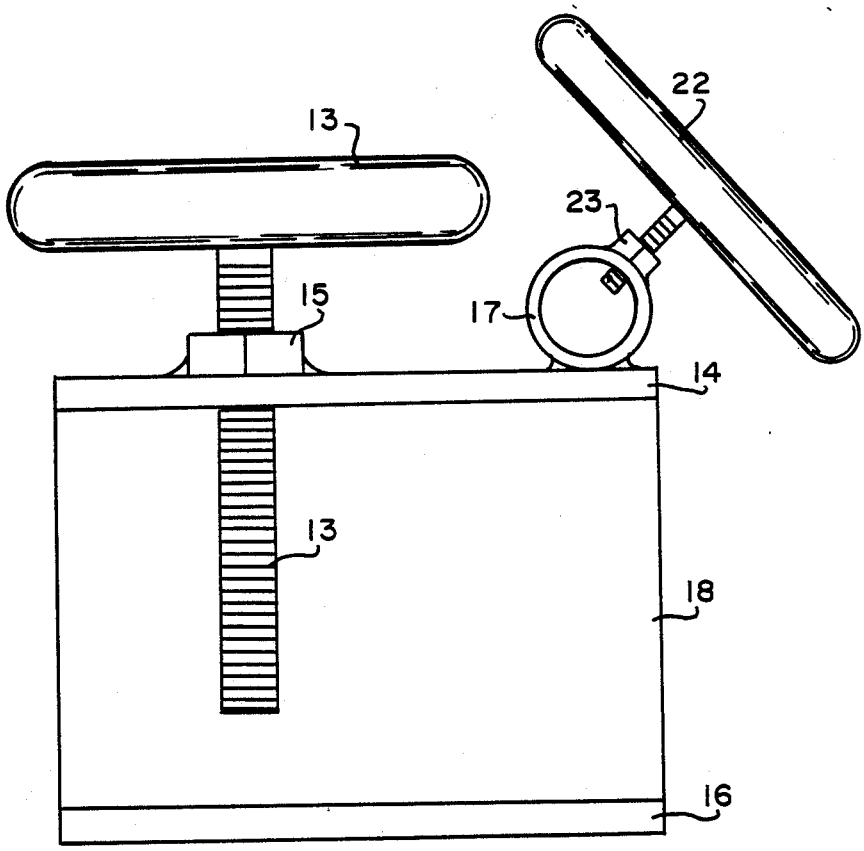
FIG. 4 is a bottom view of the mounting bracket and clamps.

Welded to the forward plate 14 is an open-ended, cylindrical tubular receptacle 17. The receptacle 17 is oriented perpendicular to the top portion 18 of the bracket 12, for insertion therein of optional gun cradles and telescope or camera mounts. The insertion of a stabilizing gun cradle 17 having a long, round shaft 20 for vertical and azimuth adjustments and a yoke 21 for a long barrel weapon is shown in FIG. 2. The vertical and azimuth adjustments are locked in position by tightening the shaft screw clamp 22 in nut 23. The nut 23 is welded to the tubular receptacle 17 in a position coaxial with a hole therein that permits contact of clamp 22 contact with the cradle shaft 20. The Tee handles of the bracket and shaft tightening clamps 13 and 22, and of yoke 21 are coated for thermal protection to the hands and for physical protection of finishes respectively. FIGS. 3 and 4 are further illustrations of the bracket assembly 12. For mechanical clearance in a small portable gun rest 10 the shaft tightener, screw clamp 22 and nut 23 are angle mounted to the forward plate 14.

Figure 5:
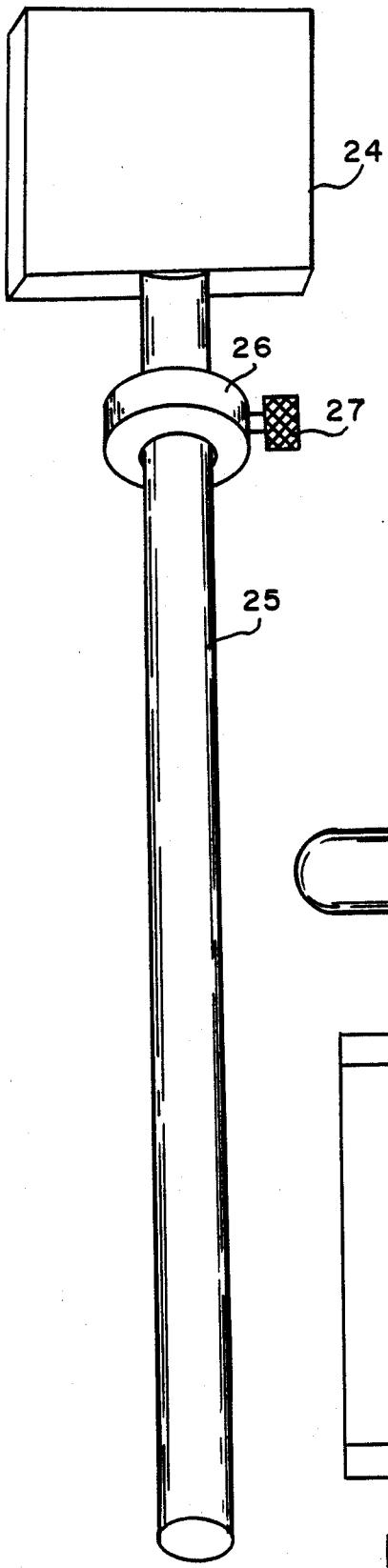
FIG. 5 is a view of the optional spotting scope and camera mount.

For the bird watcher or a game spotter the gun cradle 19 is replaced in the bracket 12 by an adaptor 24, shown in FIG. 5, to which a commercially available car window mount for spotting telescopes and camera can be attached. The adaptor 24 may be rotated in azimuth and the window mount (not shown) provides vertical tilt so that a very large field of view may be scanned.

The sportsman may wish to scan the horizontal angles of the scene from a fixed sitting or standing viewing height without having to repetitively release and reset the shaft screw clamp 22. Therefore a ring 26 is snugly fitted to slide upon either the shaft 20 of the gun rest cradle 19 or the shaft 25 of the scope/camera adaptor. The thickness of the ring is sized to provide a boss for turning upon the tubular receptacle 17 of the bracket 12. A knurled thumbscrew 27 when tightened radially through the ring 26 makes contact with shaft 20 (or 25) to establish a fixed height for a swinging gun cradle 19 or a swinging scope/camera adaptor mount 24. When a desired azimuth is found the "Tee" screw 22 is tightened to then preserve the angle as well as the viewing height.

Lightweight materials are used in the construction of the device. Variations in materials and embodiments described herein are within the scope of my invention. Having described the invention,

I claim:

1. A portable device to hold and improve the aiming of sportsmens's equipments, comprising long barrel firearms, spotting telescopes and cameras, during operations from fixed observation stands in fields and woodlands comprising:

(a) a bracket having an open-ended cylindrical receptacle thereon, said bracket for attachment to an upright component of an existing stable structure of said observation stands placing the longitudinal axis of said receptacle in a vertical plane;

(b) means for clamping said bracket to said upright component of said observation stands;

(c) a holding cradle for said long barrel firearms for optional assembly within said cylindrical receptacle, said cradle comprising:

(1) an elongated cylindrical shaft of uniform diameter for snugly fitting within said cylindrical receptacle;

(2) a U-shaped yoke for symmetrical attachment to said cylindrical shaft; and (3) a soft covering material surrounding said yoke as attached to said shaft for protecting the finishes of said firearms;

(d) a mounting adaptor for said spotting telescopes and cameras for optional assembly within said cylindrical receptacle, said mounting adaptor comprising:

(1) an elongated cylindrical shaft of uniform diameter for snugly fitting within said cylindrical receptacle;

(2) a base plate, for attachment thereto of car window mounts for spotting scopes and cameras, said base plate for permanent attachment to one end of said elongated shaft with the geometric plane of said base plate coincident with the extended longitudinal axis of said elongated shaft;

(e) an azimuth scanning ring having an inside diameter for snugly fitting upon the elongated shafts of said holding cradle and said mounting adaptor and an outer diameter at least as large as the outer diameter of said cylindrical receptacle, said ring for optional assembly on said elongated shafts between said cylindrical receptacle and said yoke and baseplate respectively;

(f) a thumb screw in a threaded radial cavity through said ring for tightening upon said elongated shafts of said cradle and said mounting adaptor, respectively, for height adjustments thereof with freedom to scan through azimuth angles; and (g) a "Tee" handle screw in a threaded nut fixed upon a cavity through said cylindrical receptacle for tightening upon said elongated shafts of said cradle and said mounting adaptor, respectively, for securing a fixed azimuth angle and a fixed viewing height for said sportsman's equipment.

2. A portable device to improve the aiming stability of a hunter's gun during operations from fixed hunting stands in fields and woodlands, comprising:

(a) a bracket for attachment to an upright component of an existing stables structure at said fixed hunting stands, comprising:

a top plate for resting on said structural upright component;

a rear plate for perpendicular attachment to the rearward edge of said top plate abutting said structural upright component;

a forward plate for perpendicular attachment to the near edge of said top to enclose said structural upright component;

an adjustable clamp for removable attachment of said bracket to said structural upright component; and an open-ended cylindrical tubular receptacle for attachment to the exterior surface of said forward plate in near proximity and parallel to an edge thereof that aligns the longitudinal axis of said cylindrical receptacle with the vertical when said top plate rests on said structured upright component, (b) a single-point cradle for assembly with said bracket in which an elongated firearm may rest, which comprises:

an elongated round shaft having a diameter of size to fit snugly within the cavity of said open-ended cylindrical tubular receptacle.

a yoke for upright attachment of its U-shaped configuration to one end of said round shaft when vertically assembled in said cylindrical tubular receptacle; and a covering of soft materials upon the surface of said yoke for the protection of the surface finishes of said gun, when resting in said cradle; and (c) apparatus for adjustment of said single-point cradle in a continuous range of heights above the floor level of said fixed stands with optional fixed and freely rotatable angles of said U-shaped yoke of said cradle in a continuous azimuth aiming field for said hunter's gun, which comprises:

said cylindrical tubular receptacle attached to a forward plate of said bracket, said receptacle having, at an exposed location, a hole extending through its wall thickness;

said elongated round shaft of said cradle placed within said tubular receptacle at an angle of said cradle yoke providing a desired aiming field, responsive to said hunter's action;

a threaded nut fixed-attached to said tubular receptacle coaxially with said hole therein;

a matching threaded T-handle screw for insertion through said nut and said tubular receptacle for making clamping contact, responsive to operation of said T-handle, with said round cradle shaft positioned in said range of heights and at continuous variable locations about the circumference thereof for said fixed adjustment of said hunter's aiming field; and an azimuth scanning ring having an inside diameter for snugly fitting upon said elongated round shaft of said cradle and an outer diameter at least as large as the outer diameter of said tubular receptacle, said ring for optional lockable assembly on said elongated round shaft between said tubular receptacle and said cradle yoke for preserving a height adjustment while releasing said cradle for scanning the aiming field through said freely rotatable angles.

* * * * *